US009238241B2

(12) United States Patent
Bloc et al.

(10) Patent No.: US 9,238,241 B2
(45) Date of Patent: Jan. 19, 2016

(54) SYSTEM FOR DISPENSING A FLUID PRODUCT PACKAGED IN A BOTTLE

(75) Inventors: Richard Bloc, Derchigny-Graincourt (FR); Hervé Imenez, Feuquières en Vimeu (FR)

(73) Assignee: ALBEA LE TREPORT, Le Treport (FR)

( * ) Notice: Subject to any disclaimer, the term of this patent is extended or adjusted under 35 U.S.C. 154(b) by 178 days.

(21) Appl. No.: 14/233,851

(22) PCT Filed: Jul. 19, 2012

(86) PCT No.: PCT/FR2012/051721

§ 371 (c)(1),
(2), (4) Date: Jan. 20, 2014

(87) PCT Pub. No.: WO2013/011246

PCT Pub. Date: Jan. 24, 2013

(65) Prior Publication Data

US 2014/0161506 A1 Jun. 12, 2014

(30) Foreign Application Priority Data

Jul. 21, 2011 (FR) ..... 11 56641

(51) Int. Cl.
*B05B 11/00* (2006.01)
*B05B 11/02* (2006.01)
*A45D 34/04* (2006.01)

(52) U.S. Cl.
CPC ..... *B05B 11/3052* (2013.01); *A45D 34/04* (2013.01); *A45D 34/042* (2013.01); *A45D 2200/055* (2013.01); *A45D 2200/056* (2013.01)

(58) Field of Classification Search
CPC ..... B05B 11/3052; A45D 2200/055; A45D 2200/056
USPC ..... 401/263, 265, 266, 188 R; 222/372, 222/373, 375, 378, 381, 383.1, 401
See application file for complete search history.

(56) References Cited

U.S. PATENT DOCUMENTS

2008/0118368 A1 5/2008 Roy
2011/0250007 A1 10/2011 Kang

FOREIGN PATENT DOCUMENTS

FR 2908843 A1 5/2008
KR 20100010657 U 10/2010
WO 2010071309 A2 10/2011

OTHER PUBLICATIONS

International Search Report mailed Nov. 27, 2012(PCT/FR2012/051721); ISA/EP.

*Primary Examiner* — David Walczak
*Assistant Examiner* — Joshua Wiljanen
(74) *Attorney, Agent, or Firm* — Banner & Witcoff, Ltd.

(57) ABSTRACT

A system for dispensing a fluid product packaged in a bottle (1), may include a withdrawing member (2); a band (6) secured to the bottle (1) having two upper arms (7) arranged either side of the nozzle (3) of the member (2) which is equipped with two external lugs (9), said arms each having an interior lug (10) positioned in the axial continuation of an external lug (9) to form a housing between them; a support (13) having a dispensing orifice (14), the arms (7) being mounted with the ability to effect a translational movement in said support; a push-button (17) which is mounted with the ability to effect a radial translational movement in relation to the support (13), said push-button having two tabs (20) each having an upper bearing surface (20*a*) bearing against an inner lug (10) an a lower bearing surface (20*b*) bearing against an outer lug (9), said bearing surfaces diverging radially so that depressing the push-button (14) causes the lugs (9, 10) to part, thus actuating the withdrawing member (2) by a depressing of the nozzle (3) and a raising of the bottle (1).

16 Claims, 8 Drawing Sheets

SYSTEM FOR DISPENSING A FLUID PRODUCT PACKAGED IN A BOTTLE

The present application is a U.S. National Phase filing of International Application No. PCT/FR2012/051721, filed on Jul. 19, 2012, designating the United States of America and claiming priority to French patent application No. 1156641, filed Jul. 21, 2011, and this application claims priority to and the benefit of the above-identified applications, which are both incorporated by reference herein in their entireties.

FIELD

The disclosure generally relates to a system for dispensing a fluid product packaged in a bottle.

BACKGROUND

In one particular application, the product is of the gel or cream type, for example for use in cosmetics or for pharmaceutical treatments. More particularly, the example dispensing system may be suitable for the application of a product such as a lip gloss or a lip care product.

Dispensing systems comprising a member for extracting a product packaged in a bottle are known, for example consisting of a pump, which has a body rigidly connected to said bottle in order to be supplied with product and a nozzle over said body. In particular, the extracting member is suitable for being actuated by means of reversible movement of the nozzle along a downward and upward axial stroke for product dispensing and intake, respectively.

Conventionally, the movement of the nozzle is actuated by a push button which is mounted on the upper end of the nozzle, said push button having a dispensing orifice connected to said nozzle and an upper axial bearing area.

The document KR-2010/001 0657 envisages a laterally mounted push button in relation to the nozzle of a pump, said push button interacting with two ribs formed on said nozzle so that a radial movement of said push button causes an engagement of said nozzle along the dispensing stroke thereof.

SUMMARY

In one example, a dispensing system can include a lateral actuation of an extracting member by means of a push button, wherein the stroke and the actuation force may be reduced, said system optionally using a standard extracting member, i.e. of the type suitable for use for axial actuation.

For this purpose, the an example embodiment relates to a system for dispensing a fluid product packaged in a bottle, said system comprising a member for extracting the packaged product having a body rigidly connected to the bottle in order to be supplied with product and a nozzle over said body, said nozzle being suitable for moving reversibly along a downward and upward axial stroke for product dispensing and intake, respectively, said system may include:

- a ring rigidly connected to the bottle and wherein the body of the member is secured tightly, said ring having two upper arms arranged on either side of the nozzle which is equipped with two outer pins, said arms each having an inner pin arranged in the axial extension of an outer pin to form a housing together;
- a supporting member having an orifice for dispensing the product, the arms being mounted in translation in said supporting member by connecting the nozzle with the dispensing orifice;

- a push button for actuating the extracting member which is mounted in radial translation in relation to the supporting member, said push button having two tabs arranged respectively in a housing formed between the pins, said tabs each having an upper bearing surface bearing on an inner pin and a lower bearing surface bearing on an outer pin, said bearing surfaces being radially divergent so that engaging the push button causes separation of the pins to actuate the extracting member by engaging the nozzle and lifting the bottle.

BRIEF DESCRIPTION OF THE DRAWINGS

Further aims and advantages of the disclosure will emerge in the following description, with reference to the appended figures, wherein.

DETAILED DESCRIPTION

Figure 1:
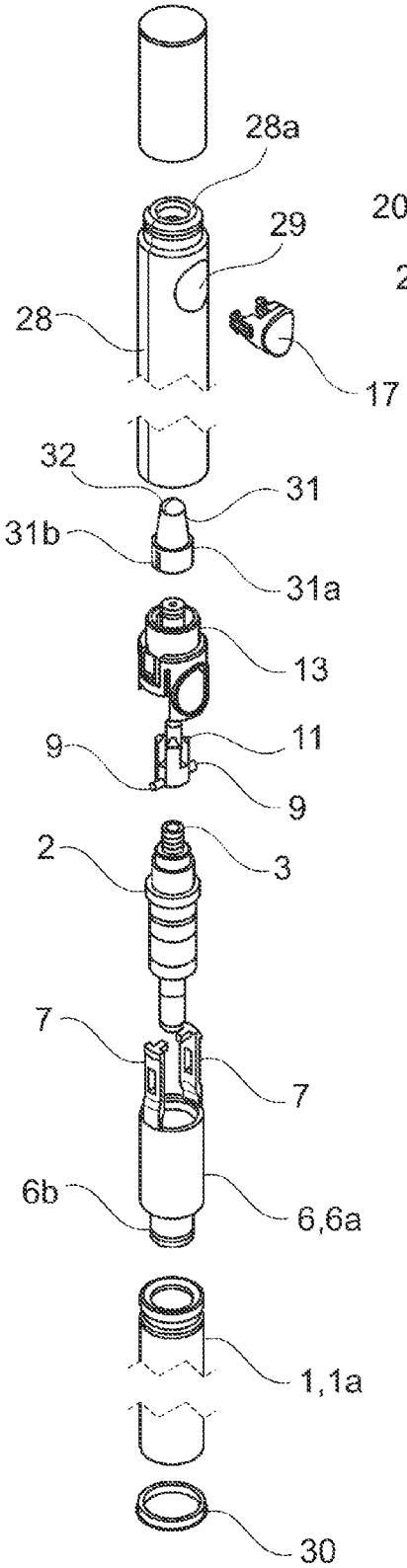
FIGS. 1-1*c* is an exploded perspective view of a dispensing system according to a first embodiment of the invention, FIGS. 1*a*, 1*b* and 1*c* being enlarged views of the push button, the supporting member and the ring shown in FIG. 1, respectively.
Figure 1A:
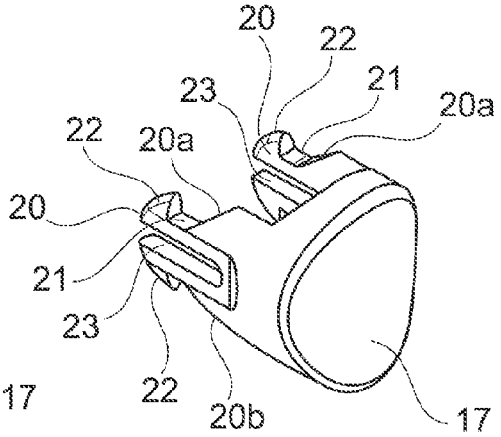
Figure 1B:
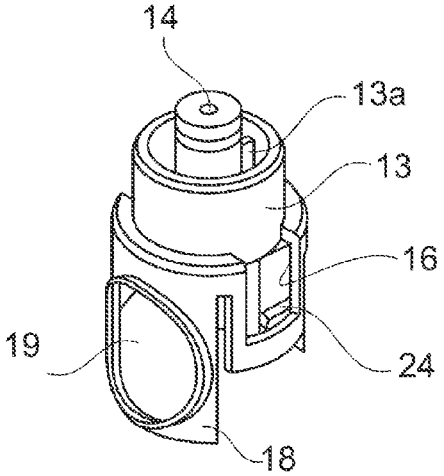

In relation to the figures, a system for dispensing a fluid product packaged in a bottle 1 is described, said product optionally being a gel or a cream, for example for cosmetic use or for pharmaceutical treatments.

The system comprises a member 2 for extracting the packaged product having a body rigidly connected to the bottle 1 in order to be supplied with product and a nozzle 3 over said body. In the embodiment shown, the sampling member is a pump 2 without the invention being restricted to such an embodiment, said pump optionally being of the type without air return while being supplied with product, for example, by actuating a scraper piston sliding in the bottle 1.

To enable extraction of the product, the nozzle 3 is suitable for moving reversibly along a downward and upward axial stroke for product dispensing and intake, respectively. In particular, the nozzle 3 may comprise a tube which is arranged in the body of the pump 2 by forming a metering chamber connected to the bottle 1 via a flap, a spring 4 being provided to return said nozzle along the intake stroke thereof.

Figure 4A:
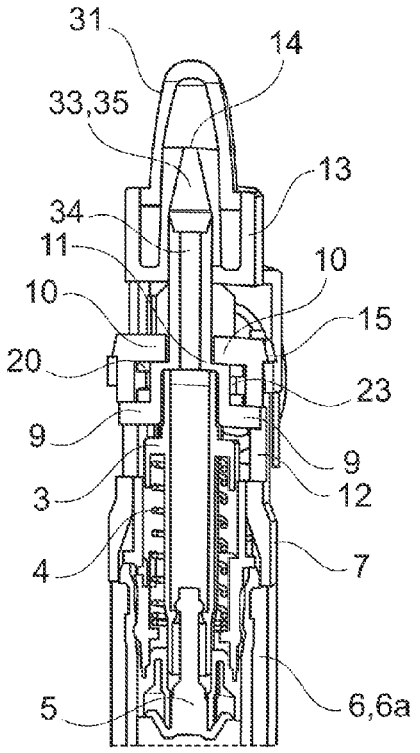
FIGS. 4*a*-4*b* are longitudinal sections of FIGS. 3*a* and 3*b;*
Figure 4B:
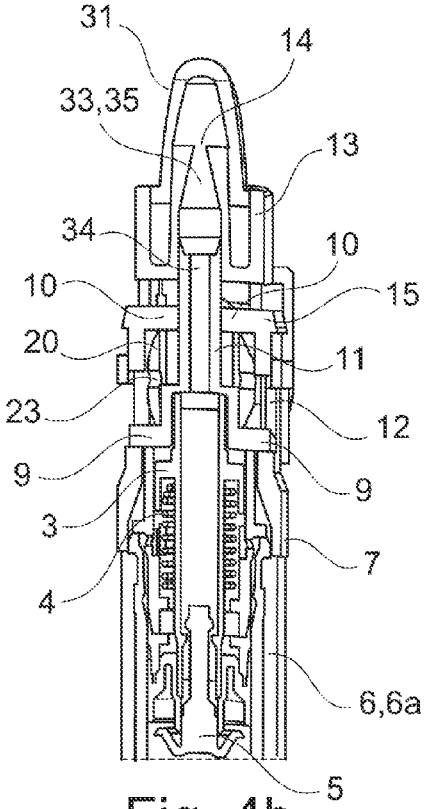

In relation to FIG. 4 wherein it is sectioned, the pump 2 is of the type described in the document FR-2 908 843, i.e. comprising a needle valve 5 arranged in the nozzle 3 to open, or close, the connection between said nozzle and the metering chamber along the dispensing, or intake, stroke. However, the invention is not restricted to a particular pump 2 structure, particularly in relation to the means required for pressurised extraction of the product to be dispensed.

The system comprises a ring 6 rigidly connected to the bottle 1 and wherein the body of the pump 2 is secured tightly. For this purpose, the ring 6 has a tubular portion 6*a* wherein the body of the pump 2 is mounted by means of tight fitting.

In the embodiment shown in FIG. 1, the bottle 1 comprises a receptacle 1*a* which is joined under the ring 6, said ring having a lower bearing surface 6*b* whereon the upper opening of the receptacle 1*a* is mounted tightly to connect the pump 2 to the inside of said receptacle. In an alternative embodiment not shown, the ring 6 may be formed of one piece along the upper portion of the bottle 1 which then comprises a mounted base to seal said bottle after the filling thereof with product.

Figure 1C:
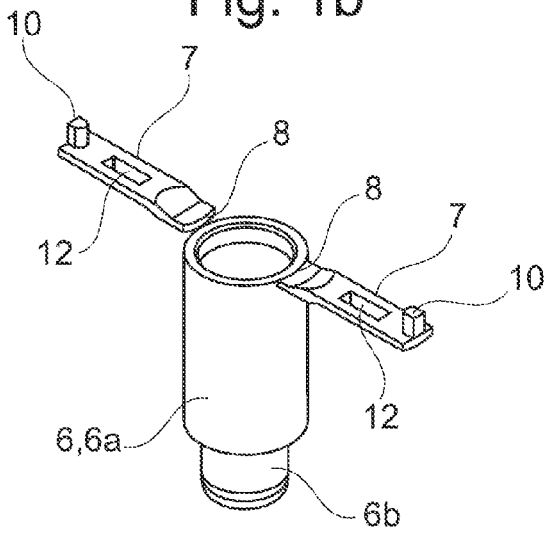
Figure 2A:
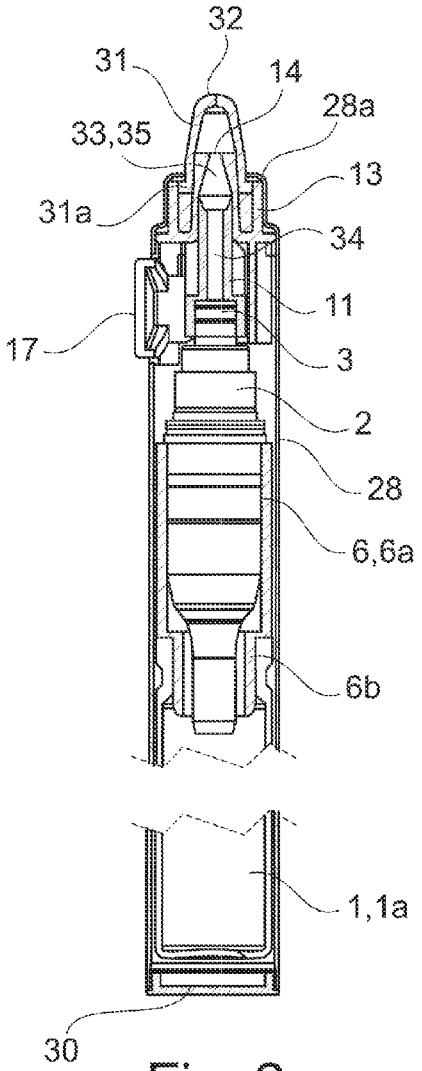
FIGS. 2*a*-2*b* are longitudinal sectional views of the dispensing system according to FIG. 1, with the push button in the idle (FIG. 2*a*) and engaged (FIG. 2*b*) position, respectively.
Figure 2B:
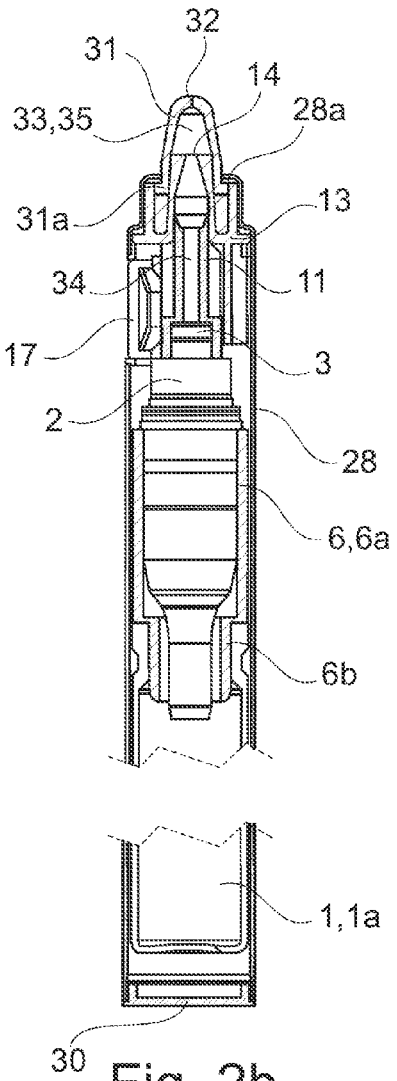

The ring 6 has two upper arms 7 which are arranged on either side of the nozzle 3. In FIG. 1, the arms 7 are integral with the tubular portion 6*a* being joined along the upper edge thereof by means of a hinge 8. This embodiment enables the arrangement of the arms 7 between a separated position (FIG. 1*c*) wherein the pump 2 can be secured in the tubular portion 6*a* and a position encompassing the nozzle 3.

The nozzle 3 is equipped with two outer pins 9 and the arms 7 each have an inner pin 10 arranged over and axially extending from an outer pin 9 to form a housing together. In the embodiments shown, the nozzle 3 is equipped with a mounted tip 11 whereon the outer pins 9 are formed. In particular, the tip 11 has a hole for mounting on the nozzle 3, the pins 9 extending radially while being diametrically distributed about said hole. In an alternative embodiment not shown, the pins 9 may be formed directly on the nozzle 3.

Moreover, the inner pins 10 extend radially while being formed in the vicinity of the upper ends of the arms 7, each of said arms having an axial groove 12 wherein an outer pin 9 is guided in translation.

The system comprises a supporting member 13 which has an orifice 14 for dispensing the product, the arms 7 being mounted in translation in said supporting member by connecting the nozzle 3 to the dispensing orifice 14. In the first embodiment, the upper ends of the arms 7 each have an outer edge 15, formed opposite the pins 10, said edge being guided in translation in a U-bolt 16 of the supporting member 13. In particular, the outer edges 15 have a bevelled end suitable for the arrangement thereof in U-bolts 16 by relative sliding of the supporting member 13 in relation to the ring 6 and a straight bottom side to prevent subsequent retraction thereof.

The system comprises a push button 17 for actuating the extracting member 2 which is mounted in radial translation in relation to the supporting member 13. For this purpose, the supporting member 13 has a front side wall 18 which is provided with an orifice 19 wherein the push button 17 is mounted, the U-bolts 16 being formed on either side of said wall (FIG. 1).

The push button 17 has two tabs 20 respectively arranged in a housing formed between the pins 9, 10, said tabs extending radially in the orifice 19 to be arranged respectively between an arm 7 and the tip 11, said tabs encompassing the nozzle 3. The tabs 20 each have an upper bearing surface 20*a* bearing on an inner pin 10 and a lower bearing surface 20*b* bearing on an outer pin 9, said bearing surfaces being radially divergent so that engaging the push button 17 causes separation of the pins 9, 10.

In this way, the extracting member 2 is actuated by combining engagement of the nozzle 3 with lifting of the bottle 1, making it possible to limit the stroke and the actuation force of the push button 17 in translation. Furthermore, after releasing the push button 17, the return of the nozzle 3 along the intake stroke thereof actuates the return of the push button 17 and the bottle 1 to the idle position. According to one example of an embodiment, the bearing surfaces 20*a*, 20*b* have a slope of 35° in order to, along a stroke less than 3.5 mm, dispense a dose in the region of 120 μl.

In the embodiments shown, the tabs 20 have a top face and a bottom face, each of said faces comprising a recess 21 bordered to the front by an outer edge 22 and to the rear by a bearing surface 20*a*, 20*b*. In this way, the idle position of the push button 17 is defined by arranging a pin 9, 10 respectively in a recess 21 of a size substantially equal to that of said pin.

The outer edges 22 have a bevelled end suitable for arranging the tabs 20 in housings formed between the pins 9, 10. In particular, for this arrangement, the pins 9, 10 are separated by bearing on the edges 22, causing actuation of the pump 2 suitable for example for use for pre-priming same.

Moreover, the pins 9, 10 interact with an outer edge 22 to prevent the retraction of the push button 17. For this purpose, the outer edges 22 have a straight rear side to prevent the retraction of the pins 9, 10 after the arrangement thereof in the recesses 21.

To guide the push button 17 in translation, each tab 20 has a central recess 23 wherein a radial slide 24 formed in the supporting member 13 is arranged. Furthermore, this embodiment is suitable for ensuring reliable transmission of the forces between the bearing surfaces 20*a*, 20*b* and the pins 9, 10 during the translation of the push button 17.

Figure 5A:
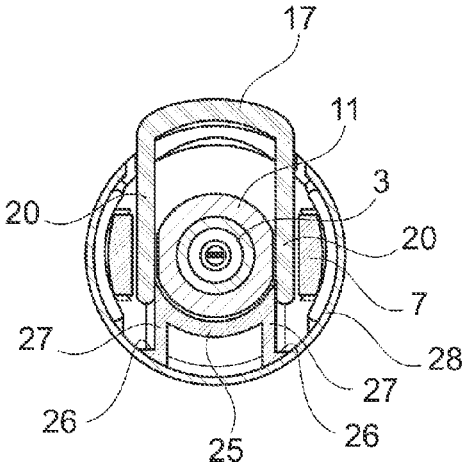
FIGS. 5*a*-5*b* are cross-sectional views showing the dispensing system according to FIG. 1 with the push button in the idle (FIG. 5*a*) and engaged (FIG. 5*b*) position, respectively.
Figure 5B:
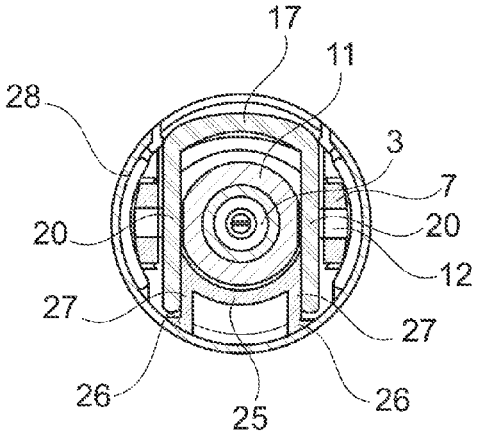
Figure 3A:
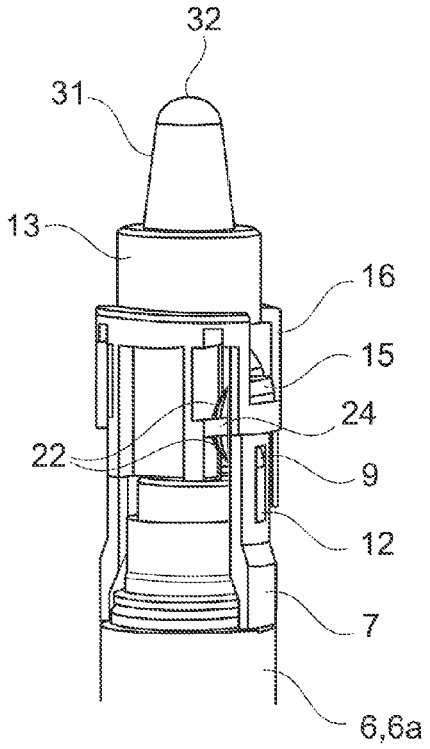
FIGS. 3*a*-3*b* are partial perspective views showing the dispensing system according to FIG. 1 without its case thereof, with the push button in the idle (FIG. 3*a*) and engaged (FIG. 3*b*) position, respectively.
Figure 3B:
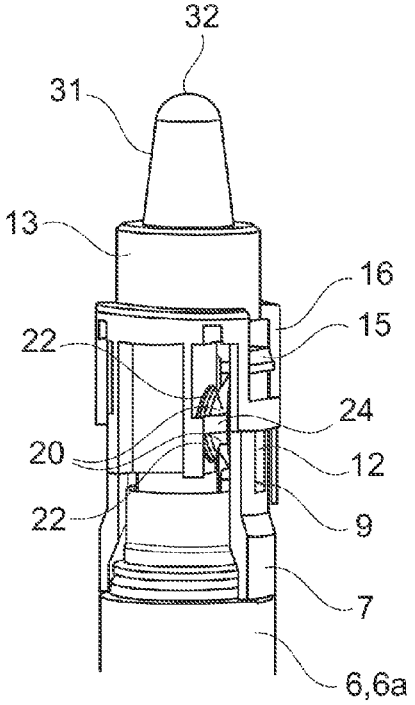

In relation to FIG. 5, the supporting member 13 has a wall 25 formed opposite the push button 17, said wall having a complementary geometry to that of a rear portion of the nozzle 3 arranged facing same. In this way, on actuation, the wall 25 is suitable for limiting any misalignment of the nozzle 3 by bearing said nozzle on said wall.

Furthermore, the supporting member 13 has at least one abutment 26 defining the end-of-travel position in respect of translation of the push button 17, this abutment 26 being suitable in particular for being readily arranged to determine the dispensed dose. In particular, the wall 25 is bordered by two radial flanks 27 against which a tab 20 respectively slides, said flanks having a base acting as the abutment 26.

In relation to the first embodiment, the system comprises a case 28 which is joined to the supporting member 13, particularly around the wall 18 and the U-bolts 16, to encompass the bottle 1, said case having a side orifice 29 arranged opposite the orifice 19 of the supporting member 13 and via which the push button 17 is accessible. In particular, the case 28 may be arranged to enhance the design of the system, an inner cap 30 optionally being provided under said case to completely conceal the bottle 1. Furthermore, the push button 17 may be encompassed by a trimming cover for concealing the edge of the orifice 29.

The system may comprise means for applying the product, said means being mounted on the dispensing orifice 14. In the first embodiment, the means are formed from a deformable sleeve 31 having an upper slot 32 suitable for opening under the pressure of the dispensed product.

This embodiment is particularly suitable for applying a product such as a lip gloss or a lip care product. Advantageously, at least the slot 32 of the sleeve 31 may be loaded with an antibacterial agent, for example based on silver, such as Alphasan or Bactiglas so as to prevent the penetration of micro-organisms through the product film clamped at said slot. Alternatively, a brush or further means for applying a product may be provided.

The supporting member 13 may comprise means for indexing the angular position of the application means in relation to the push button 17. In the first embodiment, the sleeve 31 comprises a lower collar 31*a* held around the dispensing orifice 14 by an inner bearing surface 28*a* of the case 28, the slot 32 projecting from said case. The collar 31*a* has two axial slots 31*b* wherein a knurl 13*a* of the supporting member 13 is engaged for indexing.

Advantageously, the supporting member 13 has an inner conduit 33 topped by the dispensing orifice 14 and the nozzle 3 has an upper shaft 34 tightly slidably mounted in said conduit. In particular, the tip 11 comprises an upper portion wherein the shaft 34 is formed by connecting to the nozzle 3.

This embodiment is suitable for defining in the conduit 33 a buffer chamber 35 for the extracted product for which the volume increases, or decreases, along the dispensing, or intake, stroke, of the nozzle 3. In particular, the buffer chamber 35 comprises a cylindrical lower portion wherein the shaft 34 is slidably mounted and a conical upper portion converging towards the dispensing orifice 14. The buffer chamber 35 may have a variation in volume between 30% and 100% of the dose of product extracted by the pump 2.

In this way, it is possible to obtain a movement wherein dispensing is at least partly dissociated from the application of the product. Indeed, pressing the push button 17 causes the buffer chamber 35 to fill with at least a portion of the extracted dose and, after releasing said push button, the dose is dispensed through the slot 32 by reducing the volume in said buffer chamber.

Figure 6:
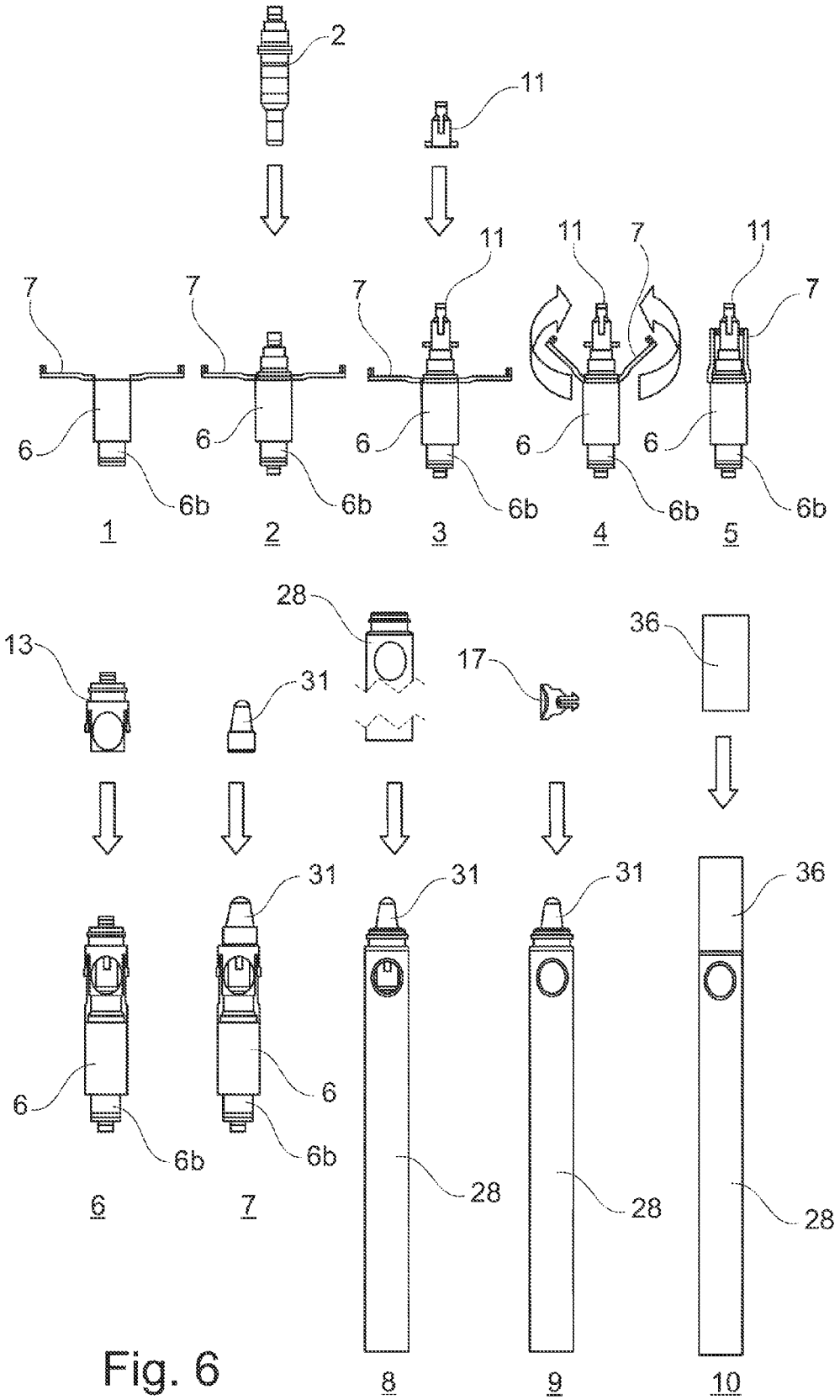
FIG. 6 illustrates the steps for assembling the dispensing system according to FIG. 1.

In relation to FIG. 6, various steps for assembling the dispensing system are described hereinafter, wherein the arms 7 are arranged in the separated position (FIG. 6.1) to secure the pump 2 in the ring 6 (FIG. 6.2). The tip 11 is then mounted on the nozzle 3 (FIG. 6.3) and the arms 7 are pulled back (FIG. 6.4) to the position encompassing the nozzle 3 with the outer pins 9 arranged in the slots 12 (FIG. 6.5).

The supporting member 13 is then arranged around the arms 7 by arranging the outer edges 15 in the U-bolts 16 (FIG. 6.6) and the sleeve 31 is mounted onto said supporting member (FIG. 6.7). The case 28 may then be mounted about the supporting member 13 and the bottle 1 (FIG. 6.8) followed by the push button 17 in the orifices 19, 29 with the tabs 20 in the housings formed between the pins 9, 10 (FIG. 6.9). A cap 36 is then mounted around the supporting member 13 to protect the sleeve 31 between two applications (FIG. 6.10).

Figure 7:
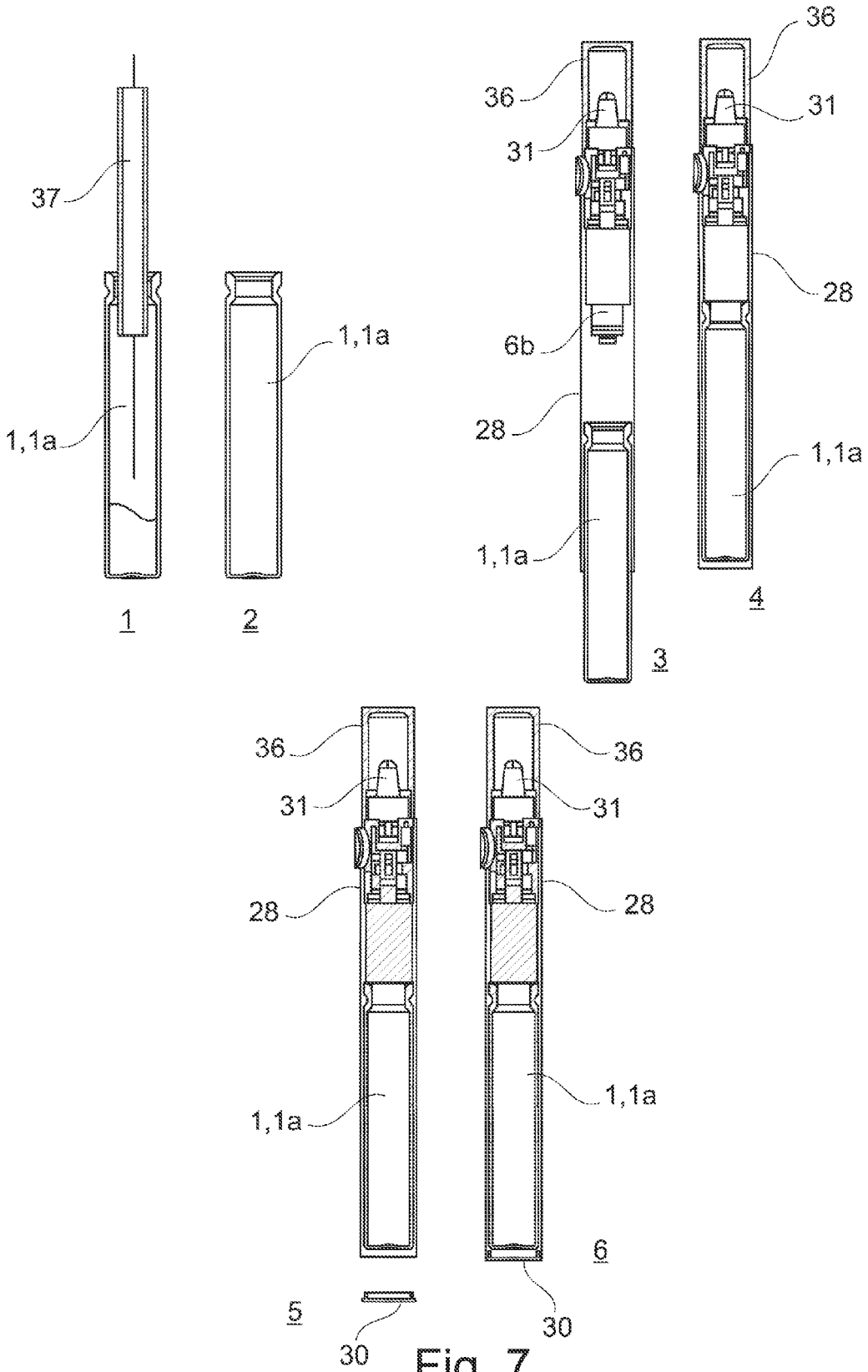
FIG. 7 illustrates steps for packaging the product and finishing the assembly of the dispensing system according to FIG. 1.

Following these steps, the dispensing system is in delivery condition and FIG. 7 illustrates various steps for packaging the product and finishing the assembly of the dispensing system.

FIGS. 7.1 and 7.2 show filling of the receptacle 1*a* with product by means of a tube 37, said receptacle then being associated under the ring 6 of the system in delivery condition (FIGS. 7.3 and 7.4). The cap 30 of the case 28 may then be mounted to finalise the dispensing system (FIGS. 7.5 and 7.6).

Figure 8:
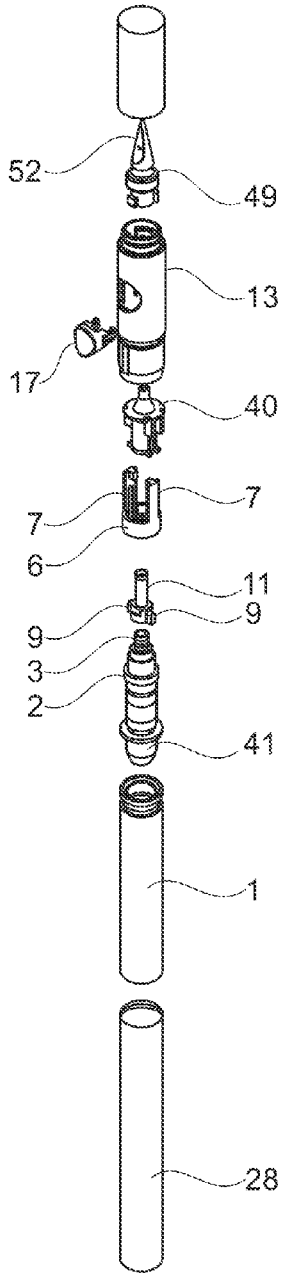
FIGS. 8-8*d* is an exploded perspective view of a dispensing system according to a second embodiment of the invention, FIGS. 8*a*, 8*b*, 8*c* and 8*d* being enlarged views of the application means-supporting member assembly, push button, ring and tip shown in FIG. 8, respectively.
Figure 8A:
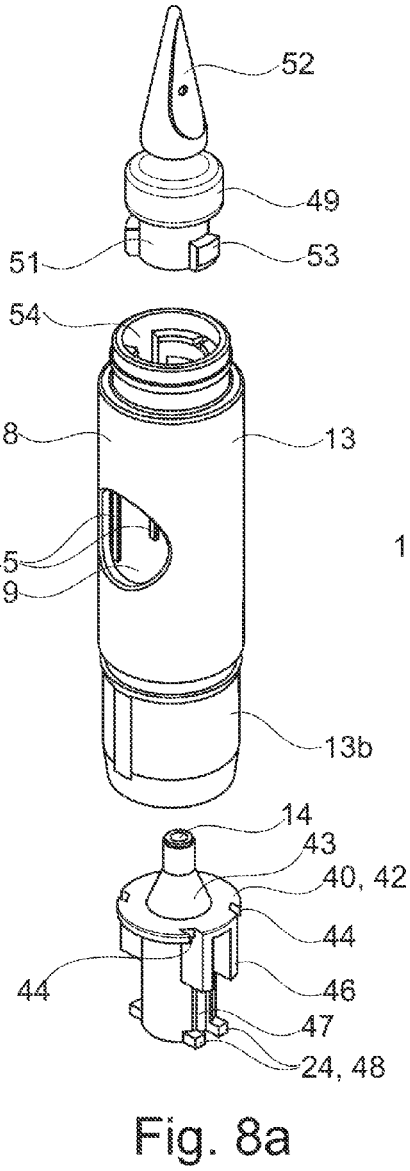
Figure 8B:
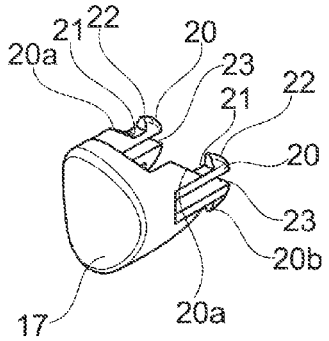
Figure 8C:
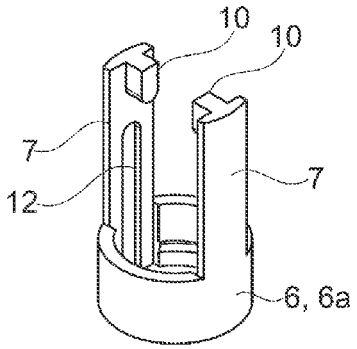
Figure 8D:
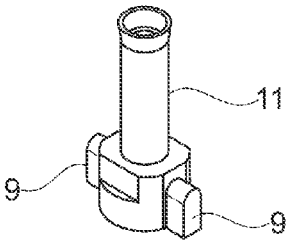
Figure 9A:
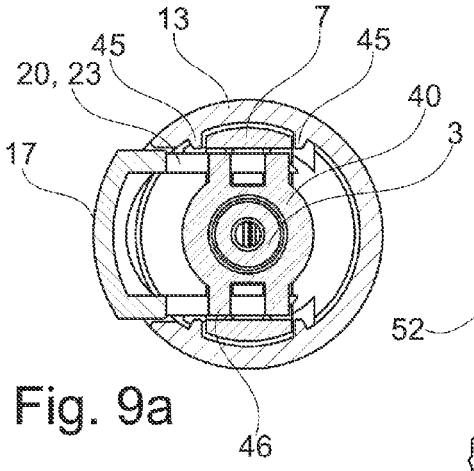
FIGS. 9*a*-9*d* represent the dispensing system according to FIG. 8 with the push button in the idle position, in a cross-section (FIG. 9*a*), partially in a perspective view without the supporting member (FIG. 9*b*) and in a longitudinal section (FIGS. 9*c* and 9*d*), respectively.
Figure 9B:
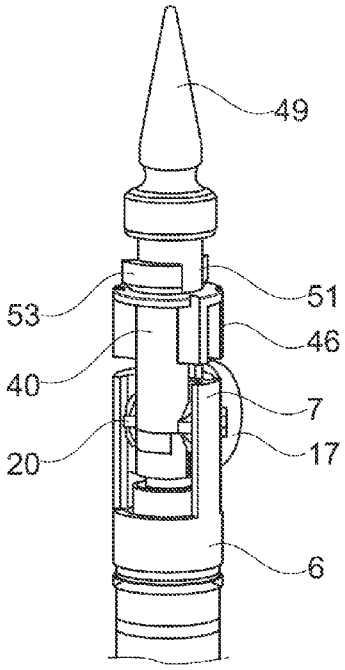
Figure 9C:
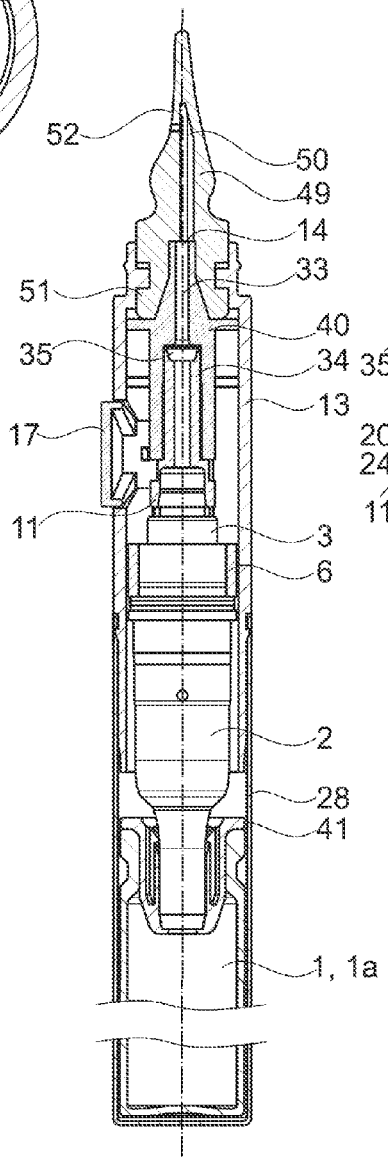
Figure 9D:
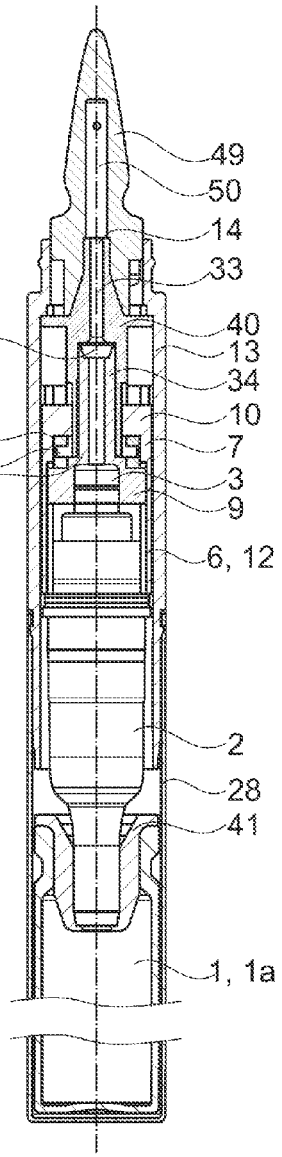
Figure 10A:
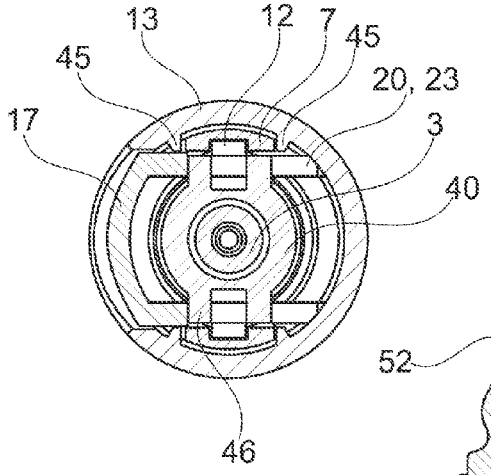
FIGS. 10*a*-10*d* represent the dispensing system according to FIG. 8 with the push button in the engaged position, in a cross-section (FIG. 10*a*), partially in a perspective view without the supporting member (FIG. 10*b*) and in a longitudinal section (FIGS. 10*c* and 10*d*), respectively.
Figure 10B:
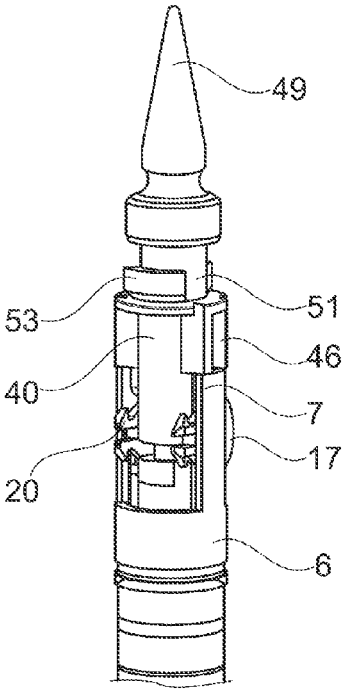
Figure 10C:
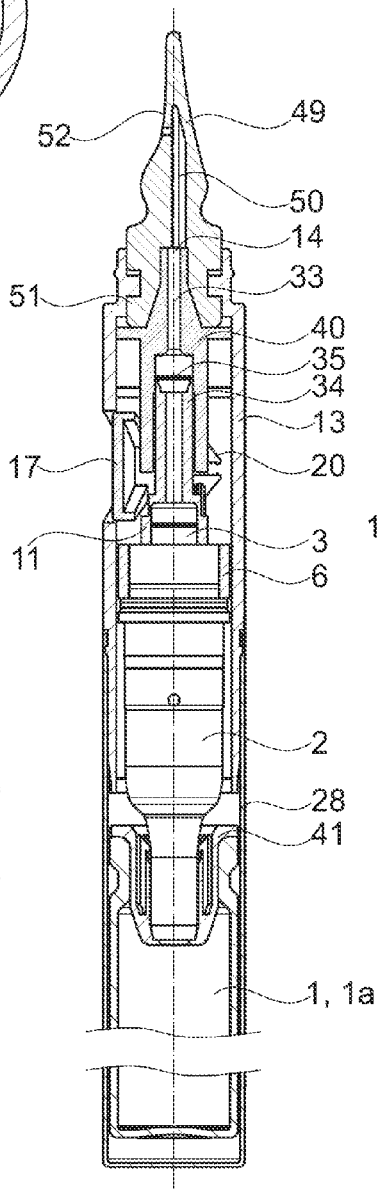
Figure 10D:
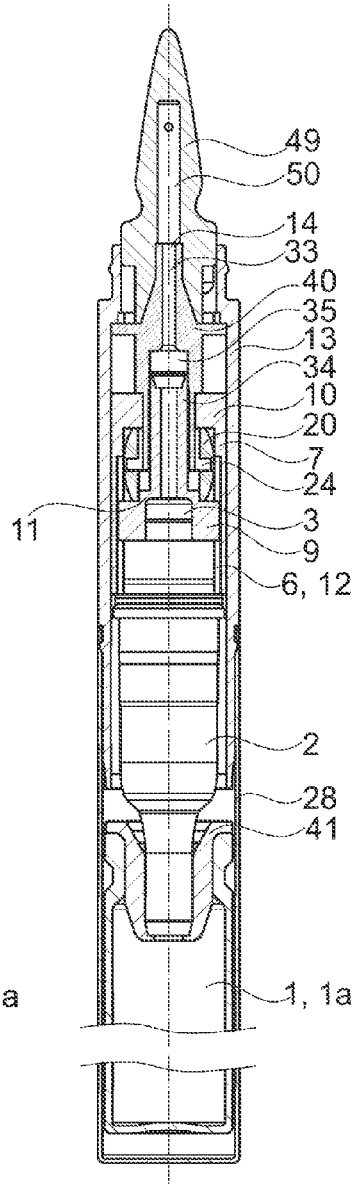

In relation to FIGS. 8 to 10, a second embodiment of a dispensing system is described hereinafter, wherein the supporting member 13 comprises an insert 40 secured inside said supporting member, said insert having the inner conduit 33 topped by the dispensing orifice 14. As in the first embodiment, the upper shaft 34 of the tip 11 is tightly slidably mounted in the conduit 33 to define the buffer chamber 35.

The dispensing system also comprises a receptacle 1*a* joined under the body of the extracting member 2, a connector 41 being provided to ensure tightness of this assembly. Moreover, a case 28 is secured under the supporting member 13 which has a lower bearing surface 13*b* for this purpose.

The insert 40 has an upper plate 42 whereon a cone 43 topped by the dispensing orifice 14 extends, said plate having four notches 44 distributed in pairs on either side of the cone 43, said notches being engaged respectively in an axial groove 45 formed inside the supporting member 13.

The grooves 45 are suitable for straight mounting of the insert 40 by sliding inside the supporting member 13 until the plate 42 is secured in said supporting member, particularly by locking. Furthermore, the insert 40 has a U-shaped bridge 46 formed between each of the pairs of notches 44 to enhance the slidable guiding of the insert 40 in the supporting member 13, particularly by limiting the rotation of said insert before locking.

The insert 40 also has two axial slots 47 formed respectively under a U-shaped bridge 46, an inner pin 10 being guided in translation in respectively a slot 47 upon actuation of the system. In particular, the arms 7 are integral with the tubular portion 6*a* while being fixedly joined on the upper edge thereof. Moreover, the arms 7 are guided in translation in the supporting member 13 between two grooves 45.

The lower end of each of the edges of the slots 47 is equipped with a pin 48. In particular, the two pins 48 of a slot 47 act as the radial slide 24 for guiding the push button 17 in translation via the central recess 23.

In the second embodiment, the application means comprise an element 49 wherein a conduit 50 is formed, extending from a base 51 to a tip wherein it opens onto a lateral application surface 52. The base 51 is equipped with reversible joining means on the supporting member 13 by placing the dispensing orifice 14 in the conduit 50. In FIGS. 8 to 10, the joining means comprise two blocks 53 for a bayonet type assembly in recesses 54 formed in the supporting member 13.

The invention claimed is:

1. A system for dispensing a fluid product packaged in a bottle, said system comprising:

a member for extracting the packaged product having a body rigidly connected to the bottle in order to be supplied with product and a nozzle over said body, said nozzle being suitable for moving reversibly along a downward and upward axial stroke for product dispensing and intake, respectively, a ring rigidly connected to the bottle and wherein the body of the member (2) is secured tightly, said ring having two upper arms arranged on either side of the nozzle which is equipped with two outer pins, said arms each having an inner pin arranged in the axial extension of an outer pin to form a housing together;

a supporting member having an orifice for dispensing the product, the arms being mounted in translation in said supporting member by connecting the nozzle with the dispensing orifice; and a push button for actuating the extracting member which is mounted in radial translation in relation to the supporting member, said push button having two tabs arranged respectively in a housing formed between the pins, said tabs each having an upper bearing surface bearing on an inner pin and a lower bearing surface bearing on an outer pin, said bearing surfaces being radially divergent so that engaging the push button causes separation of the pins to actuate the extracting member by engaging the nozzle and lifting the bottle.

2. The dispensing system according to claim 1, wherein the inner pins (10) are formed in the vicinity of the upper ends of the arms, each of said arms having an axial groove wherein an outer pin is guided in translation.

3. The dispensing system according to claim 1, wherein the arms are joined to a tubular portion of the ring by means of a hinge suitable for arranging said arms between a separated position and a position encompassing the nozzle.

4. The dispensing system according to claim 1, wherein the ring is formed along the upper portion of the bottle which comprises a mounted base.

5. The dispensing system according to claim 1, wherein the bottle comprises a receptacle joined under the ring or under the extracting member.

6. The dispensing system according to claim 1, wherein the nozzle is equipped with a mounted tip whereon the outer pins are formed.

7. The dispensing system according to claim 1, wherein the supporting member has an inner conduit topped by the dispensing orifice, the nozzle having an upper shaft tightly slidably mounted in said conduit so as to define in said conduit a buffer chamber for the extracted product for which the volume increases, or decreases, along the dispensing, or intake, stroke, of the nozzle.

8. The dispensing system according to claim 7, wherein the buffer chamber has a variation in volume between 30% and 100% of a dose of product extracted by the member.

9. The dispensing system according to claim 1, further comprising a case which is joined to the supporting member in order to encompass the bottle.

10. The dispensing system according to claim 1, further comprising means for applying the product, said means being mounted on the dispensing orifice.

11. The dispensing system according to claim 1, wherein the upper ends of the arms each have an outer edge which is guided in translation in a U-bolt of the supporting member.

12. The dispensing system according to claim 1, wherein the tabs (20) have a top face and a bottom face, each of said faces comprising a recess bordered to the front by an outer edge and to the rear by a bearing surface, a pin being arranged respectively in a recess to define the idle position of the push button, said pin interacting with an edge to prevent the retraction of the push button.

13. The dispensing system according to claim 1, wherein each tab has a central recess wherein a radial slide formed in the supporting member is arranged to guide the translation of the push button.

14. The dispensing system according to claim 1, wherein the supporting member has at least one abutment defining the end-of-travel position in respect of translation of the push button.

15. The dispensing system according to claim 1, wherein the supporting member has a wall formed opposite the push button, said wall having a complementary geometry to that of a rear portion of the nozzle arranged facing same.

16. The dispensing system according to claim 1, wherein the supporting member comprises an insert secured inside said supporting member, said insert having the dispensing orifice.

* * * * *